United States Patent [19]

Hale

[11] Patent Number: 5,010,743

[45] Date of Patent: Apr. 30, 1991

[54] TEST FITTING ADAPTER FOR REFRIGERANT LINES

[75] Inventor: Phillip L. Hale, Rowlett, Tex.

[73] Assignee: Richard E. Glaser, Dallas, Tex. ; a part interest

[21] Appl. No.: 451,291

[22] Filed: Dec. 15, 1989

[51] Int. Cl.[5] ..... F25B 45/00

[52] U.S. Cl. ..... 62/292; 62/149

[58] Field of Search ..... 62/149, 292; 137/322, 137/614.05; 251/347, 348, 148, 149.8; 141/311, 348, 349

[56] References Cited

U.S. PATENT DOCUMENTS

| | | | |
|---|---|---|---|
| 3,208,232 | 9/1965 | Madison et al. | 62/292 X |
| 3,243,969 | 4/1966 | Dirk | 62/149 X |
| 3,785,163 | 1/1974 | Wagner | 62/292 X |
| 3,916,641 | 11/1975 | Mullins | 62/292 |
| 4,069,686 | 1/1978 | Hoelman | 62/292 |
| 4,476,892 | 10/1984 | Boyce | 137/322 |
| 4,745,772 | 5/1988 | Ferris | 62/292 |

*Primary Examiner*—Lloyd L. King
*Attorney, Agent, or Firm*—Daniel Rubin

[57] ABSTRACT

A tubular adapter fitting for attachment to the service connector of a refrigeration unit enabling receipt of a quick disconnect coupler to attach the coupler end of refrigeration tubing in flow communication therewith. The fitting in comprised of a tubular body adapted at one end for mounting onto a service connector. A contoured periphery serves to receive a quick connect coupler almost instantaneously in a pressure tight interlock relation thereon. Two adapter fitting embodiments are disclosed, one of which is particularly suited to a threaded service connector of a type normally provided with the refrigerant unit of a vehicular air conditioning system. The second embodiment of the adapter fitting is more suited to servicing non-vehicular refrigerant systems in which a service connector is not normally provided in advance by the manufacturer of the equipment but must be provided by the serviceman on site.

4 Claims, 1 Drawing Sheet

TEST FITTING ADAPTER FOR REFRIGERANT LINES

TECHNICAL FIELD

The field of art to which the invention pertains comprises the art of apparatus for servicing refrigeration systems.

BACKGROUND OF THE INVENTION

Servicing of refrigeration or air conditioning systems providing less than satisfactory performance usually involves a check-out of the refrigeration side of the system. This entails obtaining pressure measurements on both the high pressure and low pressure or suction side of the compressor. Service connectors to which a pressure gauge can be connected are commonly provided for this purpose in the refrigerant tubing by the fabricator of the system or alternatively are improvised by the serviceman on site. The procured pressure measurements enable a diagnostic analysis of system performance while identifying deficiencies in the system that can be readily remedied for improving system operation to manufacturer's standards.

BACKGROUND OF THE PRIOR ART

With low pressure and high pressure service connectors being available or provided on the refrigerant system for pressure gauge connection, a customary professional approach to servicing, involves use of a gauge manifold by which the pressure measurements can be obtained. The manifold typically includes two pressure gauges, one for each of the high and low range of pressure readings to be obtained. Flexible tubing via a shut-off valve is adapted by means of a female coupling at the tube ends to connect each of the pressure gauges with a respective of the service connectors. Additional tubing, centrally connected to the manifold intermediate the others is adapted to receive a refrigerant bottle by which refrigerant can be introduced into the system through the manifold and the suction tubing. A less sophisticated, more amateur approach to servicing is to utilize a single gauge with tubing connected to the suction side alone.

A primary objective, particularly on vehicular service, is to minimize loss of pressurized refrigerant from the system during the course of threadedly attaching the tubing coupler onto the service connector. Such loss is not only costly, but is considered to have a deleterious effect on the atmospheric ozone layer. Frequently, however, the vehicular service connectors are located in an intensely hot, relatively secluded or inaccessible location about the engine compartment of the vehicle. Threaded placement and coupling of the tube end on the service connector becomes increasingly difficult under those circumstances. It is known in those situations for the mechanic attempting the coupling connection to fumble and incur severe hand burns in the course of placement. It can be appreciated also that fumbling delays effecting the connection during which much of the refrigerant loss occurs.

OBJECTS OF THE INVENTION

It is an object of the invention to provide a novel fitting adapter for servicing refrigeration systems enabling a quick disconnect coupler to be utilized on either or both the high and low side service connector for coupling the manifold tubing with great dispatch.

It is the further object of the invention to effect the previous object with a relatively low cost fitting adapter.

It is a still further object of the invention to effect the previous objects with a fitting adapter that is operably effective in combination with a quick disconnect coupler to minimize, if not eliminate, potential refrigerant loss from the system.

SUMMARY OF THE INVENTION

The invention relates to a fitting adapter to expedite coupling of the manifold tubing with the refrigeration service connector of a refrigeration system to be pressure tested. More specifically, the invention relates to a fitting adapter which when in place on either or both the high and low side service connectors of the refrigeration system enables a quick disconnect coupler to be utilized for achieving an almost instantaneous coupling of the manifold tubing to the service connector.

The foregoing is achieved for vehicular servicing in accordance with a first embodiment by an elongated tubular fitting adapter having an internally disposed displaceable depressor rod. One end of the adapter includes a female coupler for threaded attachment to the refrigeration service connector containing a Schrader valve in the outlet. About the periphery displaced longitudinally from the coupler, the fitting includes an annular recess formed of spaced apart inwardly chamfered shoulders. By means of the peripheral contour, the adapter can readily and reliably receive a commercially available form of quick disconnect tubular coupler in a pressure sealing interlock relation thereon. The coupler disconnect includes a depressor rod which when installed on the adapter causes the depressor of the adapter to be urged against the actuator pin of the connector Schrader valve. The opposite end of the coupler disconnect includes a fitting to which the manifold tubing is customarily pre-attached.

In a second embodiment for servicing refrigeration units on which service connectors had not previously been supplied the adapter fitting hereof is suitable for sweat fitting or welding in a permanent installation onto the outlet of a service connector provided on site. The adapter fitting of this embodiment omits the depressor rod of the previous embodiment, but includes instead a Schrader valve that is omitted from the service connector. Installation of the fitting adapter of this embodiment is normally effected when the refrigeration system is evacuated.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
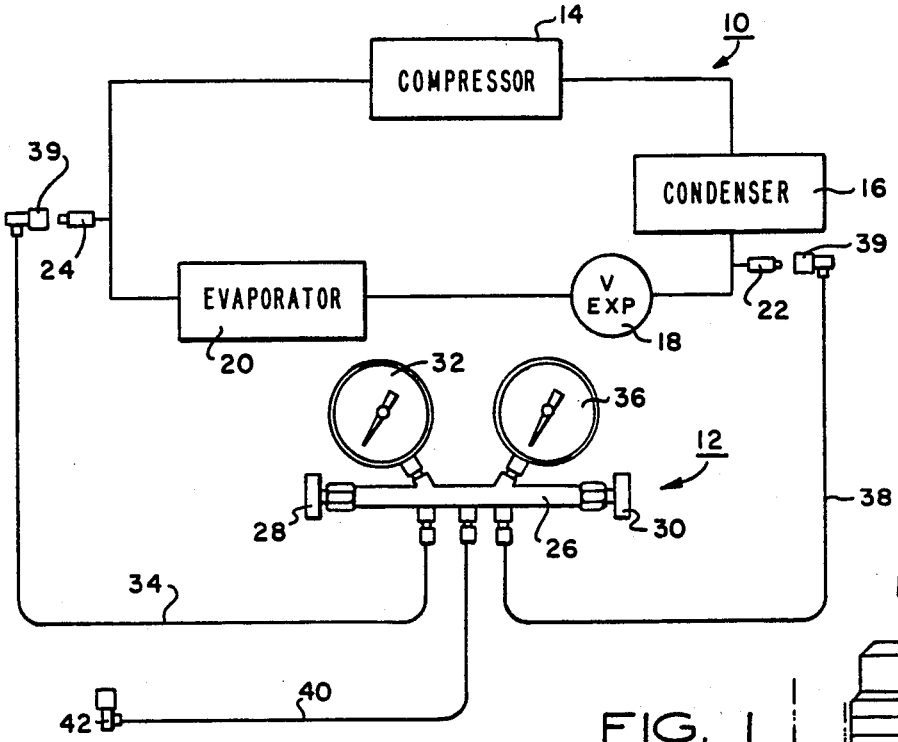
FIG. 1 (PRIOR ART)
FIG. 1 is a schematic representation of a typical prior art refrigeration system being pressure tested by a manifold gauge unit.

In the description which follows, like parts are marked throughout the specification and drawings with the same reference numerals respectively. The drawing figures are not necessarily to scale and the proportions of certain parts may have been exaggerated for purposes of clarity.

Referring now to FIG. 1, there is illustrated a typical vehicular refrigeration system designated 10 with which a typical manifold gauge hookup designated 12 is utilized whereby operation of the refrigeration system can be diagnosed. The refrigeration system per se employs the well-known refrigeration cycle comprised of a compressor 14, condenser 16, expansion valve 18 and evaporator 20. Service connectors 22 and 24 are typically provided by the vehicle manufacturer for enabling high side and low side pressure readings to be obtained respectively. Except when testing is to be performed, each of the service connectors are normally covered by a screw-on cap and each includes a Schrader valve whereby testing can be performed and refrigerant added or removed as required.

The manifold assembly 12 includes a manifold tube 26 including end valve 28 that controls the flow between pressure gauge 32 and flexible tubing 34. End valve 30 controls the flow between pressure gauge 36 and flexible tubing 38. Each of the tubings 34 and 38 include a threaded female connector 39 at their distal ends for coupling their respective tubings with the threaded service connectors of the refrigeration system. Central tubing 40 includes a connector 42 at its distal end to which a source of pressurized Freon or other suitable refrigerant can normally be attached.

It will be appreciated from the foregoing that threadedly attaching the female disconnect of the manifold tubing directly to either or both of service connectors 22 and 24 can be difficult when the latter are disposed in a relatively inaccessible location about the engine compartment. Such difficulty is compounded when working closely adjacent a hot engine of a recently driven vehicle and during which mechanic fumbling in the course of installation can readily occur. Any undue delay in effecting the coupled joint after the Schrader valve is depressed but prior to a seal being obtained can cause significant amounts of Freon to escape the system before actual testing analysis can be conducted.

Figure 2:
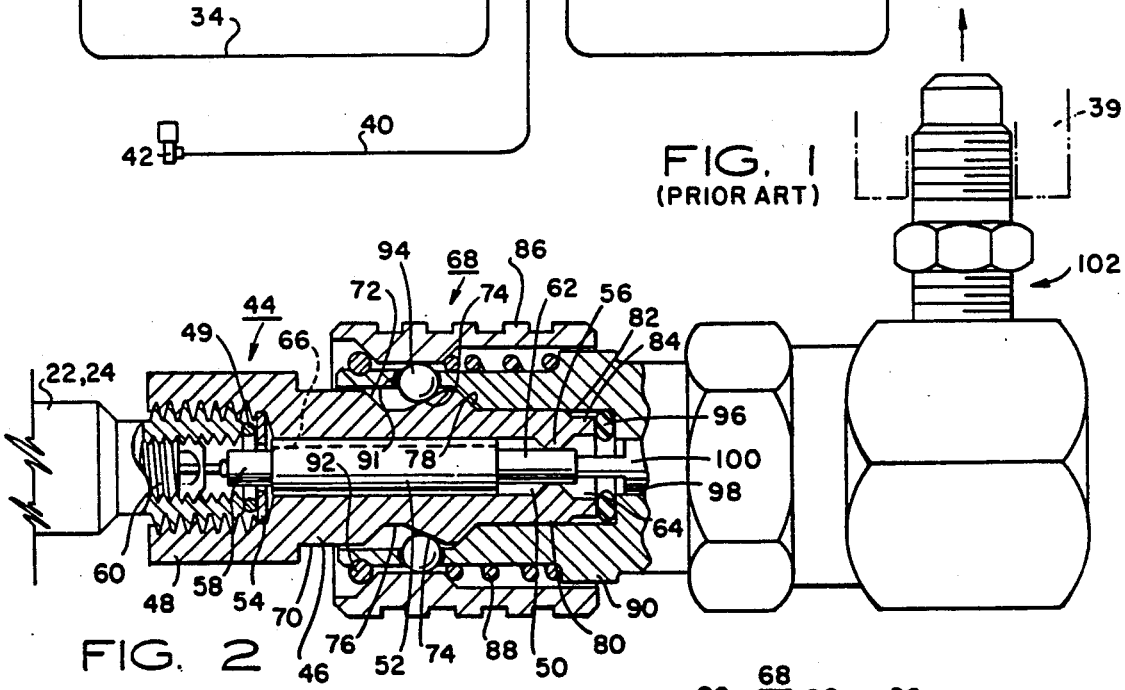
FIG. 2 is an enlarged view partially sectioned for a first embodiment of the adapter fitting of the invention with a quick disconnect coupler in place.

Referring now to FIG. 2, there is disclosed the novel service adapter fitting hereof designated 44. As here illustrated the adapter is shown in a completed connection to manifold assembly 12 via a quick disconnect coupler 68. Comprising the adapter 44 is an elongated tubular body 46 of brass or other suitable metal. The body is enlarged at its left end to define a female coupler 48 internally threaded and outwardly knurled for effecting a threaded attachment to a service connector 22, 24. An O-ring neoprene seal 49 affords a pressure tight connection as the adapter fitting 44 is threadedly tightened onto the end of the service connector. Typically, the coupler end 48 is available in different sizes to accommodate 5/16-inch, 7/16-inch and ⅜-inch service connectors 22, 24 utilized by the vehicle manufacturers.

The central bore 50 within body 46 contains a loose fitting elongated depressor rod 52 that is slidable within the bore between a snap-in metal washer 54 and a narrowed annular shoulder 56. The narrow diameter extension 58 on the left end of the depressor rod is adapted to extend through washer 54 for engaging the actuator stem of the Schrader valve 60 in the service connector. The opposite end extension 62 extends through the narrowed passage created by the annular internal shoulder 56 to normally extend beyond the fitting body outward of end face 64. For permitting gas flow past depressor rod 52, the rod includes a longitudinal slot 66 (shown in phantom) while sufficient flow clearance is provided between the internal diameter of shoulder 56 and the outside diameter of end extension 62. When the actuator pin of the Schrader valve 60 is depressed in the manner illustrated, gas flow can occur bidirectionally between the service connector and the adapter fitting. The direction of flow will depend on whether Freon is being drawn from the high pressure side or added to the system via the low pressure side from a Freon source (not shown) connected at coupler 42.

The exterior periphery of body 46 includes a plurality of annular longitudinally spaced surfaces for enabling the adapter fitting to cooperate with a quick disconnect coupler 68 in effecting a rapid coupling and decoupling of the manifold tubing with the adapter 44. For these purposes, the body includes a relatively large diameter periphery 70 extending contiguously from the backside of the coupler 48 until merging with an inwardly chamfered surface 72. The latter in cooperation with a spaced oppositely chamfered surface 74 define an intervening annular recess 76. Beyond the recess the periphery is chamfered at 78 inwardly toward a sleeve-like extension 80 terminating at a shoulder 82 that merges with the nose end 84 extending to the distal end face 64.

Quick disconnect coupler 68 is of a type commercially available from various sources and may, for example, be of a type manufactured by Robinair Division of Seal Power Corp., of Montpelier, Ohio, as their model ACT110. Briefly, the disconnect coupler 68 includes a retractable outer sleeve 86 that is biased leftwardly (as viewed in the drawing) by an internal spring 88 encircling a tubular body 90. The distal end of body 90 includes a retaining ring 92 while a plurality of circumferentially spaced apertures 91 contain radially displaceable balls 94. An internal elastomeric O-ring 96 receives the end face 64 of the adapter fitting. The central bore 98 contains a depressor rod 100 having an end extension 101. When the disconnect coupler is positioned in place on the adapter fitting, extension 101 will engage extension 62 of the adapter fitting depressor rod 52 to force the latter against the Schrader valve 60. A side fitting 102 receives the tubing coupler 39 of the hoses 34 and 38 and which in accordance herewith are normally left permanently attached.

In operation, adapter 44 of this embodiment is first threaded onto a service connector during which the depressor rod 52 is generally limp therein disengaged from the actuator pin of the Schrader valve 60. This serves to avoid any premature release of gas pressure from within the refrigerant system 10. Quick disconnect coupler 68 is previously attached to one of the hoses 34, 38 via tubing coupler 39 secured to fitting 102. By retracting outer sleeve 86 of the quick disconnect coupler 68, the disconnect coupler can be manually inserted over and onto the fitting. When the fitting and coupler are fully engaged, sleeve 86 is released. This causes the connection between the manifold assembly 12 and the refrigerant system 10 to be immediately effected as the balls 94 interlock into fitting recess 76. When effecting the installation, the end face 64 of the adapter engages O-ring 96 to obtain a pressure tight relation thereat. At the same time, the extension 101 of the disconnect depressor rod 100 will displace the depressor rod 52 of the adapter causing end extension 58 to depress the actuator pin of the Schrader valve 60. Once the fitting and disconnect are positioned in place, a direct flow connection is supplied between the refrigerant system 10 and one of the pressure gauges 32, 36 via their respective shut-off valves 28 and 30. After pressure testing is completed, quick disconnect coupler 68 can be almost instantaneously withdrawn by reversing the foregoing steps. Adapter fitting 44 can either be subsequently removed or permitted to remain in place as preferred.

Since the connection and disconnection of the manifold assembly 12 to the service connectors utilizing the adapter fitting 44 hereof are almost instantaneous, Freon loss, if any, is minimized to the extent possible. At the same time, the previous mechanic fumbling imposed Freon loss that occurred during coupling of the hose ends to the refrigerant system is substantially, if not completely, avoided. This affords the adapter fitting a distinct advantage over the existing prior art coupling connections utilized previously.

Figure 3:
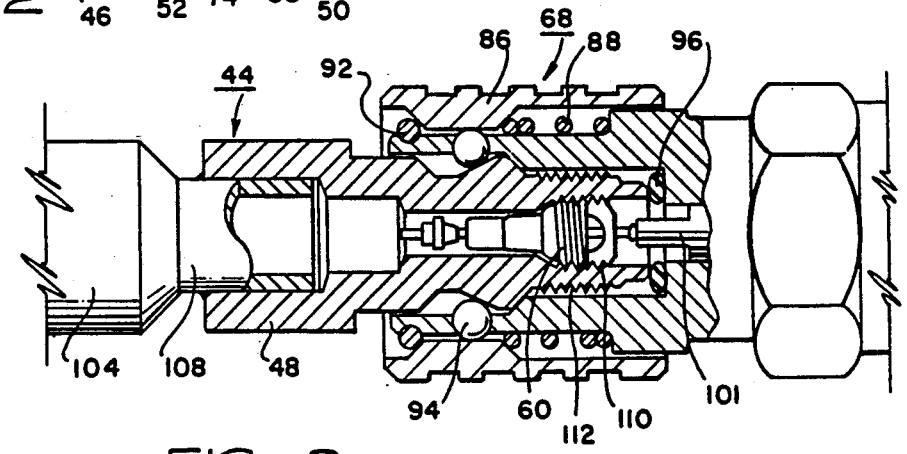
FIG. 3 is a partially sectioned view similar to FIG. 2 for a second embodiment of the adapter fitting of the invention.

The second embodiment of adapter fitting illustrated in FIG. 3 is normally utilized for servicing non-vehicle type refrigerant units in which service connectors are not typically provided previously by the manufacturer of the equipment. When servicing is required, the serviceman will typically improvise service connectors, here designated 104, for placement into the refrigerant lines (not shown) and with which the second embodiment of the adapter fitting 44 is utilized.

For this embodiment, coupler end 48 of the adapter fitting includes an internal smooth bore 106 enabling the fitting to be sweat fit or welded onto the end extension 108 of the service connector. At the opposite end, central bore 106 is internally threaded at 110 to receive and contain a Schrader valve 60. External threads 112 enable a cap (not shown) to be applied subsequently after quick disconnect coupler 68 is removed. The external periphery of this embodiment is otherwise similar to the previous embodiment to readily receive quick disconnect coupler 68.

By the above description, there has been disclosed a novel test fitting adapter for connecting the service connector of a refrigeration line to a manifold gauge assembly by which a pressure analysis of the system can be conducted. The adapter is of a relatively simple construction externally contoured for enabling use of a quick disconnect coupler so as to eliminate much of the Freon losses previously experienced. Moreover, the previous fumbling and difficulty of coupling the manifold tubing to the service connector is avoided particularly where the latter is located relatively inaccessible or in a high temperature area. While being simple and relatively inexpensive to fabricate, the service adapter fitting hereof fulfills a long-felt need in simplifying the coupling connection necessary for performing pressure test analysis of a refrigeration unit.

Since many changes could be made in the above construction and many apparently widely different embodiments of this invention could be made without departing from the scope thereof, it is intended that all matter contained in the drawings and specification shall be interpreted as illustrative not in a limiting sense.

I claim:

1. In a system for diagnostic servicing a vehicular refrigeration unit having a male threaded service connector and located in the engine vicinity within the engine compartment of the vehicle by obtaining a pressure measurement of the refrigerant gas contained in the unit including a pressure gauge, flexible tubing secured in communication with said pressure gauge, and a coupling at the distal end of said tubing for attaching said tubing to a threaded service connector of a vehicular refrigeration unit to be serviced, the improvement for placement intervening the service connector and the tube coupling comprising:

an adapter fitting having a threaded female connector at one end for effecting a pressure tight attachment to the service connector of the refrigeration unit and having an unthreaded male configured opposite end for receipt of a female quick disconnect tubular coupler; and a female quick disconnect coupler to which the distal end of said tubing can be attached and adapted to effect a quick joinder at said opposite end of said adapter fitting with the coupling of said tubing.

2. The improvement in accordance with claim 1 in which said adapter fitting comprises:

a tubular body defining a central passage having a threaded female connector at said one end for effecting said attachment onto a service connector of a vehicular refrigeration unit to be serviced;

an exterior periphery defining said opposite end about said body to enable receipt of said quick disconnect coupler in a pressure tight coupled relation about said body; and operable means disposed internally of said central passage for cooperating with the quick disconnect coupler received thereon to communicate refrigerant gas pressure between said connected service connector and said tubing to said pressure gauge.

3. An adapter fitting for diagnostic servicing a vehicular refrigeration unit having a male threaded service connector and located in the engine vicinity within the engine compartment of the vehicle, said fitting comprising:

a tubular body defining a central passage and having a threaded female connector at one end for mounting onto the threaded service connector of the vehicular refrigeration unit to be serviced;

an exterior periphery defined in a male configuration about said body at the other end to enable receipt of a female quick disconnect tubular coupler in a pressure-tight coupled relation about said body; and operable means disposed internally of said central passage for cooperating with the quick disconnect coupler received thereon to internally communicate refrigerant gas pressure between the connected service connector to outward of the received quick disconnect coupler.

4. An adapter fitting in accordance with claim 1 in which said operable means comprises a longitudinally displaceable depressor rod extendable against the actuator pin of a Schrader valve disposed in the service connector.

* * * * *